US011521573B2

(12) United States Patent
Sariarslan

(10) Patent No.: US 11,521,573 B2
(45) Date of Patent: Dec. 6, 2022

(54) ELECTRONIC DEVICES AND METHOD OF OPERATING ELECTRONIC DEVICES

(71) Applicant: Vestel Elektronik Sanayi ve Ticaret A.S., Manisa (TR)

(72) Inventor: Muhammet Kürsat Sariarslan, Manisa (TR)

(73) Assignee: VESTEL ELEKTRONIK SANAYI VE TICARET A.S., Manisa (TR)

( * ) Notice: Subject to any disclaimer, the term of this patent is extended or adjusted under 35 U.S.C. 154(b) by 0 days.

(21) Appl. No.: 17/311,628

(22) PCT Filed: Dec. 10, 2018

(86) PCT No.: PCT/EP2018/084235
§ 371 (c)(1),
(2) Date: Jun. 7, 2021

(87) PCT Pub. No.: WO2020/119885
PCT Pub. Date: Jun. 18, 2020

(65) Prior Publication Data

US 2022/0028352 A1 Jan. 27, 2022

(51) Int. Cl.
*G09G 5/00* (2006.01)

(52) U.S. Cl.
CPC ..... *G09G 5/006* (2013.01); *G09G 5/005* (2013.01); *G09G 2354/00* (2013.01); *G09G 2370/04* (2013.01); *G09G 2370/12* (2013.01); *G09G 2370/16* (2013.01)

(58) Field of Classification Search
CPC combination set(s) only.
See application file for complete search history.

(56) References Cited

U.S. PATENT DOCUMENTS

2004/0216172 A1 10/2004 Perlman
2004/0219824 A1 11/2004 Conn
2005/0018084 A1 1/2005 Cho
(Continued)

FOREIGN PATENT DOCUMENTS

EP 1772965 A2 4/2007
EP 1950662 A2 7/2008
(Continued)

OTHER PUBLICATIONS

English machine translation of JP 2006046931 published on Feb. 16, 2006 (13 pages).

*Primary Examiner* — Abbas I Abdulselam
(74) *Attorney, Agent, or Firm* — J. Miguel Hernandez; James R. Gourley; Carstens, Allen & Gourley, LLP

(57) ABSTRACT

First and second electronic devices are provided in which in use one of the devices acts as a source of at least one of video and audio which is sent to the other device over a cable. The first device detects that a cable connector of a cable has been connected to the socket of the first device. The first device transmits a wireless signal for receipt by the second device. The wireless signal indicates at least one of the type of signal that is output or input at that socket of the first device and the type of socket for that socket of the first device. In response to the second device receiving the wireless signal, the second device indicates a corresponding socket on the second device to which a cable connector at the other end of the cable should be connected.

20 Claims, 1 Drawing Sheet

(56) References Cited

U.S. PATENT DOCUMENTS

| | | | | |
|---|---|---|---|---|
| 2007/0264862 | A1 | 11/2007 | Hallberg | |
| 2008/0016528 | A1 | 1/2008 | Yoshinaga | |
| 2008/0133047 | A1 | 6/2008 | Best et al. | |
| 2008/0157978 | A1 | 7/2008 | Kotzin et al. | |
| 2008/0309511 | A1 | 12/2008 | Kerr et al. | |
| 2013/0017696 | A1 | 1/2013 | Rivera | |
| 2013/0263482 | A1* | 10/2013 | Strater | G09F 3/201 40/316 |
| 2016/0285922 | A1 | 9/2016 | Ramalingam et al. | |

FOREIGN PATENT DOCUMENTS

| | | | |
|---|---|---|---|
| EP | 2418830 | B1 | 4/2013 |
| JP | 2006046931 | A | 2/2006 |
| WO | 2010052128 | A1 | 5/2010 |

* cited by examiner

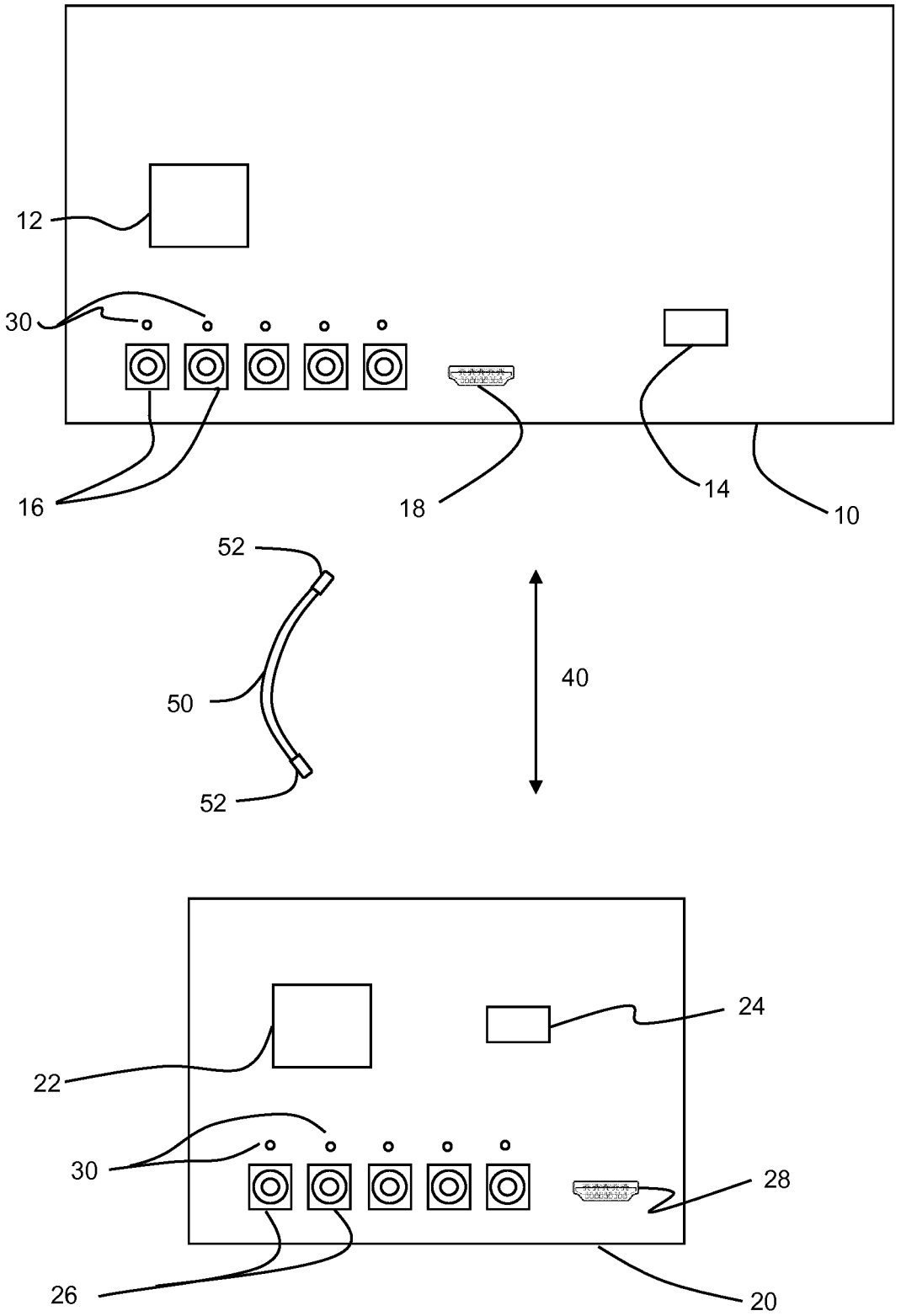
12
30
16
18
14
10
52
50
52
40
24
22
30
28
26
20

ELECTRONIC DEVICES AND METHOD OF OPERATING ELECTRONIC DEVICES

CROSS REFERENCE TO RELATED APPLICATION

This application is a US 371 application from PCT/EP2018/084235 entitled "ELECTRONIC DEVICES AND METHOD OF OPERATING ELECTRONIC DEVICES" filed on Dec. 10, 2018 and published as WO 2020/119885 A1 on Jun. 18, 2020. The technical disclosures of every application and publication listed in this paragraph are hereby incorporated herein by reference.

TECHNICAL FIELD

The present disclosure relates to electronic devices and a method of operating first and second electronic devices.

BACKGROUND

Many electronic devices have a number of sockets to which cables may be connected for sending or receiving audio and/or video and/or other signals. Some sockets are very different from each other. Other sockets may be similar or even identical to each other and yet may be used to carry different types of signal. It is important to ensure that a cable is connected to the correct socket on each device so that the audio and/or video signals and/or other signals are sent and received as desired or necessary. This can however be a difficult or confusing task for users.

SUMMARY

According to a first aspect disclosed herein, there is provided a method of operating first and second electronic devices, in which in use one of the devices acts as a source of at least one of video and audio which is sent to the other device over a cable, the method comprising:

detecting at a socket of the first device that a cable connector of a cable has been connected to the socket of the first device;

in response to detecting that a cable connector has been connected to the socket of the first device, the first device transmitting a wireless signal for receipt by the second device, the wireless signal indicating at least one of (i) the type of signal that is output or input at that socket of the first device and (ii) the type of socket for that socket of the first device; and in response to the second device receiving the wireless signal, the second device indicating a corresponding socket on the second device to which a cable connector at the other end of the cable should be connected.

In this way, a user can simply connect one end of a cable to a socket on one of the devices. The device can then transmit a wireless signal for the other device so that the other device can indicate the correct corresponding socket on the other device to which the other end of the cable should be connected. This greatly simplifies the connecting of cables to sockets on source and receiver devices for users.

In some cases, the type of signal that is output or input at that socket of the first device and the type of socket for that socket of the first device may in effect be the same. That is, in some cases, it is sufficient to indicate either the type of signal or the type of socket. In other cases, it may be necessary, or at least useful, to indicate both the type of signal and the type of socket.

In an example, in response to detecting that the cable connector at the other end of the cable has been connected to the indicated socket of the second device, the second device transmits a wireless signal for receipt by the first device, the wireless signal indicating that a correct connection has been made.

In an example, in response to receiving from the second device the wireless signal that indicates that a correct connection has been made, the first device ceases transmitting the wireless signal for receipt by the second device.

In an example, the second device indicates a corresponding socket on the second device to which the cable connector at the other end of the cable should be connected by illuminating a light emitter in the region of said corresponding socket on the second device.

In an example, the second device comprises a display screen, and the second device indicates a corresponding socket on the second device to which the cable connector at the other end of the cable should be connected by displaying a representation of the location of said corresponding socket on the display screen of the second device.

According to a second aspect disclosed herein, there is provided an electronic device for acting as at least one of a source and a receiver of at least one of video and audio which in use is sent to or received from respectively another device over a cable, the electronic device comprising:

at least one socket for receiving a cable connector of a cable which in use carries at least one of a video signal and an audio signal which is output or input at the socket;

a cable detector for detecting that a cable connector has been connected to the socket; and a wireless transmitter for transmitting wireless signals;

the device being arranged to cause the wireless transmitter to transmit a wireless signal for receipt by another device when a cable connector of a cable has been connected to the socket, in which the wireless signal indicates at least one of (i) the type of signal that is output or input at that socket and (ii) the type of socket for that socket, whereby, upon receipt of said wireless signal, a said other device can indicate a corresponding socket on said other device to which the cable connector at the other end of the cable should be connected.

In an example, the device comprises a wireless receiver for receiving wireless signals, the device being arranged such that, in response to receiving from a said other device a wireless signal that indicates that a correct connection has been made at said other device, the device ceases transmitting the wireless signal for receipt by another device.

In an example, the device comprises a wireless receiver for receiving wireless signals, the device being arranged to indicate the socket or one of the sockets on the device to which a cable connector of a cable should be connected in response to receiving a wireless signal from another device which indicates at least one of (i) the type of signal that is output or input at a socket of said other device to which a cable connector at the other end of a said cable is connected and (ii) the type of socket for a socket of said other device to which a cable connector at the other end of a said cable is connected.

That is, if the device has a single socket, and it is the correct socket for the cable, then that socket is indicated; or if the device has plural sockets, then a correct one of those sockets for the cable is indicated.

In an example, the device is arranged to indicate the socket or a socket on the device to which the cable connector of a said cable should be connected by illuminating a light emitter in the region of said socket on the device.

In an example, the device comprises a display screen, the device being arranged to indicate the socket or a socket on the device to which the cable connector of a said cable should be connected by displaying a representation of the location of said socket on the display screen.

According to a third aspect disclosed herein, there is provided an electronic device for acting as at least one of a source and a receiver of at least one of video and audio which in use is sent to or received from respectively another device over a cable, the electronic device comprising:

a wireless receiver for receiving wireless signals; and at least one socket for receiving a cable connector of a cable which in use carries at least one of a video signal and an audio signal which is output or input at the socket;

the device being arranged to indicate the socket or one of the sockets on the device to which a cable connector of a cable should be connected in response to receiving a wireless signal from another device which indicates at least one of (i) the type of signal that is output or input at a socket of said other device to which a cable connector at the other end of a said cable is connected and (ii) the type of socket for a socket of said other device to which a cable connector at the other end of a said cable is connected.

That is, if the device has a single socket, and it is the correct socket for the cable, then that socket is indicated; or if the device has plural sockets, then a correct one of those sockets for the cable is indicated.

In an example, the device is arranged to transmit a wireless signal for receipt by said other device in response to detecting that the cable connector of a said cable has been connected to the indicated socket of the device, the wireless signal indicating that a correct connection has been made.

In an example, the device is arranged to indicate the socket or a socket on the device to which the cable connector of a said cable should be connected by illuminating a light emitter in the region of said socket on the device.

In an example, the device comprises a display screen, the device being arranged to indicate the socket or a socket on the device to which the cable connector of a said cable should be connected by displaying a representation of the location of said socket on the display screen.

BRIEF DESCRIPTION OF THE DRAWINGS

To assist understanding of the present disclosure and to show how embodiments may be put into effect, reference is made by way of example to the accompanying drawings in which:

FIG. 1 shows schematically an example of first and second electronic devices according to an embodiment of the present disclosure.

DETAILED DESCRIPTION

As mentioned, many electronic devices have a number of sockets to which cables may be connected for sending or receiving audio and/or video and/or other signals. Commonly, one device acts as a signal source for another device and sends signals, such as audio and/or video signals and/or other signals, to the other device, typically for play back or other use at the receiver device. It is important to ensure that a cable is connected to the correct sockets on source and receiver devices. This can however be a difficult or confusing task for users.

To illustrate this, many consumer and other electronic devices have a number of sockets for receiving or sending video and audio signals and/or other signals. These sockets and the corresponding connectors on the cables may be of the same type, even though some sockets/cables may be for video and some may be for audio say. Moreover, even if the cable is intended to be carrying video say, the video signal as transmitted over the cable may conform to a particular standard or be of a particular type and there will be different sockets on the device corresponding to different standards or types. Similar problems arise for audio signals. Furthermore, within say a particular video standard or type, a number of cables may need to be connected to carry different components (e.g. different colours or colour channels) of the video signal. Likewise, for an audio signal, there may be different cables for left and right in say a stereo set-up, or for front left, front right, rear left, rear right, centre and subwoofer in a 5.1 system, etc. Furthermore, there may be sockets for other purposes than sending or receiving video or audio, including sockets for cables that carry other data or for connection to a network. Despite the fact that the cables are intended in use to carry different types of signals, it is common for the cable connectors and therefore the sockets on the device to be similar and even identical in some cases.

As a particular example and without limitation, a common type of connector and socket is the RCA or phono connector and socket, which is used for outputting or inputting a number of different types of signal. As a specific example, again to illustrate this and without limitation, a television set may have separate sockets for Y, Pb, Pr (that is, three separate sockets for analog component video signals); for R, G, B (that is, three separate sockets for analog RGB video signals); for audio in left and audio in right; for CVBS (Composite Video Blanking & Sync) in, CVBS audio in right and CVBS audio in left; for audio out left and audio out right; for subwoofer out; for SPDIF (Sony/Philips Digital Interface Format) out or in, etc. These sockets are often similar in appearance. Indeed, these sockets are often all RCA or phono sockets.

Another common type of connector is an HDMI (High-Definition Multimedia Interface) connector. HDMI connectors are used to carry digital audio, digital video or both digital audio and video, as well as optionally other signals such as control signals for different purposes. There are in fact a number of different standard HDMI connectors, which are of different sizes and which have different numbers of pins and different pin layouts.

In short, it can be difficult and confusing for users to identify the correct socket when the user is attempting to connect a cable to a device. Also, depending on the location of the devices, it may not be easy for the user to see the sockets on the device when trying to connect cables. The device may for example be high up in a room or close to a wall such that the sockets are not easily visible.

To solve this, in outline in accordance with examples of embodiments of the present disclosure, when a cable is connected to a device, that device wirelessly transmits a signal for receipt by another device. That signal indicates at least one of the type of signal that will be output at or can be input to that socket or the type of that socket. The other device, upon receiving the wireless signal, can then indicate for the user the correct corresponding socket on the other device to which the other end of the cable should be connected. Accordingly, in this respect, all the user has to do is connect a cable to a socket on one device, and the other device is caused or prompted automatically to indicate the correct corresponding socket to which the other end of the cable should be connected.

Referring to FIG. 1, this shows schematically examples of two electronic devices 10, 20 according to an embodiment of the present disclosure.

Each of the devices 10, 20 may be of many different types, including for example a television set, a display screen or panel, a set-top box, a PVR (personal video recorder, also known as a DVR or digital video recorder), a DVD player, a Blu Ray player, a personal computing device such as a laptop or desktop or tablet computer, a video game console, a cellular phone (including a so-called "smart phone"), a media player, a loudspeaker, a surround sound processor or home theatre system, etc. One of the devices 10, 20 will typically be one type of device and the other of the devices 10, 20 will be another type of device. One of the devices 10, 20 will typically act as a source of a signal for the other electronic device 10, 20. In some implementations, the same device 10, 20 may be a source of some signals and a receiver of other signals.

For example, and without limitation, a user may be connecting a television set to a set-top box, a PVR and a surround sound processor or home theatre system. In a 5.1 sound system, the surround sound processor or home theatre system in turn needs to be connected to six loudspeakers (being front left, front right, centre, rear left, rear right and subwoofer). Connecting all of these devices for video and audio requires a large number of cables to be connected between the various devices. For a number of these connections, the sockets on the various devices and the corresponding connectors on the cables may be identical even though they are carrying different signals (for example, audio left and audio right respectively) or even different types of signals (for example, video and audio respectively). In some cases, the signal may be a signal out from the device or a signal in to the device depending on the specific set-up.

Each of the devices 10, 20 has a processor, data storage, working memory, etc. 12, 22 for storing and processing computer programs or software and for storing and processing data, etc. In some examples, methods described herein are implemented under control of the respective processors, etc. 12, 22.

At least one of the devices 10, 20 has a wireless transmitter and the other has a wireless receiver for respectively transmitting wireless signals to and receiving wireless signals from the other electronic device 10, 20. In some examples, each of the devices 10, 20 has a wireless transceiver 14, 24 for transmitting and receiving wireless signals 40. The wireless transceivers 14, 24 may in general be capable of transmitting wireless signals 40 to each other using one or more of a number of different wireless technologies, including for example Bluetooth, Wi-Fi, infrared and ZigBee or some other local wireless communication technique. The wireless signals 40 may be transmitted directly between the devices 10, 20 or via a network, such as for example a wireless local area network, using for example a wireless router or the like to which each device 10, 20 is connected.

Each of the devices 10, 20 has at least one socket 16, 18, 26, 28 to which a cable 50 having a corresponding connector 52 at each end can be connected. In a typical implementation, each of the devices 10, 20 has plural sockets 16, 18, 26, 28 for receiving respective cable connectors. In the schematic examples shown, each device 10, 20 is shown as having five sockets 16, 26 of one type (in this example, the RCA or phono type) and a further single socket 18, 28 of another type (in this example, an HDMI type). However, as will be well understood, for any particular device 10, 20 there may be more or fewer sockets and more or fewer types of socket. In some examples, all of the sockets may be of the same type. In other examples, there may be more than two different types of socket.

Each socket 16, 18, 26, 28 is typically for carrying a specific signal and no other signal, though, in some cases, a particular socket 16, 18, 26, 28 may be used for different types of signal depending on the set-up. For example, in the case that a device 10, 20 is a television set, there may be three sockets for respectively carrying the Y, Ph, Pr signals of a composite video signal, and/or three sockets for respectively carrying the R, G, B of analog RGB video signals, which in either case might be received from for example a DVD player or set-top box, etc.; there may be separate sockets for left and right audio in, for receiving audio from for example a DVD player or set-top box, etc.; there may be separate sockets for left and right audio out, or for the separate analog audio signals for a 5.1 or 7.1 audio, which are intended to be passed to corresponding loudspeakers; there may be sockets for CVBS (Composite Video Blanking & Sync) in, CVBS audio in right and CVBS audio in left. In some examples, all of such sockets may be RCA or phono sockets for receiving RCA or phono connectors. There may also be a socket for an SPDIF connection, for passing for example a digital 5.1 audio signal to a surround sound processor/amplifier. There may also be sockets for one or more of SDI (Serial Digital Interface), DVI (Digital Visual Interface), HDMI (High-Definition Multimedia Interface, DisplayPort, and Ethernet amongst others.

As noted, in outline in accordance with examples of embodiments of the present disclosure, when a cable 50 is connected to a socket 16, 18, 26, 28 of a device 10, 20, the wireless transceiver 14, 24 of that device 10, 20 wirelessly transmits a signal for receipt by the wireless transceiver 14, 24 of the other device 10, 20. That signal indicates at least one of the type of signal that will be output at or can be input to that socket 16, 18, 26, 28 or the type of that socket 16, 18, 26, 28 of the first device 10, 20. The other device 10, 20, upon receiving the wireless signal, can then indicate for the user the correct corresponding socket 16, 18, 26, 28 on the other device 10, 20 to which the other end of the cable 50 should be connected.

The type of signal which may be indicated may be as simple and broad as for example "video" or "audio". Alternatively or additionally, the type of signal which may be indicated may be more specific.

For example, the type of signal may indicate that it is an analog left stereo audio signal or an analog right stereo audio signal, or a specific one of the analog signals of 2.1, or 5.1 or 7.1 audio, etc.

As another example, the type of signal may indicate that it is a digital audio signal, such as for example a digital 5.1 or 7.1 audio signal. Examples of digital 5.1 audio signals include signals in accordance with Dolby Digital, Dolby Pro Logic II, DTS, SDDS and THX (and extensions to 7.1 audio, etc.).

As another example, the type of signal may indicate that it is an analog video signal, and may indicate a specific analog video signal, such as for example a composite video signal, an S-video signal, a component video signal or one of the VGA format video signals. In the case that there are different sockets 16, 18, 26, 28 on the devices 10, 20 for different components or channels of such signals, the type of signal may indicate the specific component or channel (such as for example Y, Pb, Pr of an analog component video signal, or R, G, B of an analog RGB video signal).

As another example, the type of signal may indicate that it is a digital video signal, such as for example a digital optical audio signal or a digital electrical audio signal. The type of signal may be more specific and indicate for example that it is an SDI, or DVI, or HDMI, or DisplayPort, etc. signal.

In each case, the type of signal may indicate whether, for that device 10, 20, the signal is "in" (i.e. it is intended to be received at that device 10, 20) or "out" (i.e. that it is intended to be sent by that device 10, 20).

The type of socket which may be indicated may be for example HDMI, optical (e.g. TOSLINK or SPDIF for audio), coaxial (e.g. RCA or phono), DVI, DisplayPort, Ethernet, etc.

In some cases, the type of signal that is output at a socket of a device and the type of socket for that socket of the device may in effect be the same. That is, in some cases, it is sufficient to indicate either the type of signal or the type of socket. In other cases, it may be necessary, or at least useful, to indicate both the type of signal and the type of socket.

As specific examples, for some socket types, the signal type is (at least potentially) always the same or, because of the underlying technology, it does not matter whether the signal is say video or audio or signalling, etc., as the socket or its driver or the like handles the incoming or outgoing signal regardless. Such socket types include for example DVI, DisplayPort, Ethernet and USB. For sockets like this, it can be sufficient simply to indicate the "type of socket" and it is not necessary to indicate the "type of signal".

On the other hand, there are sockets for which the signal type information is important. A particular example is when the socket is an RCA or phono type. As mentioned, RCA or phono connectors and sockets are used for outputting or inputting a number of different types of signal.

Also, in a particular implementation on specific devices 10, 20, the same RCA socket may be used for, for example, either CVBS video or a Y of YPbPr signal. In such a case, the signal type information should be sent by the device 10, 20 in addition to sending the socket type information. In this way, the other device 10, 20 can indicate the correct socket for the other end of the cable 50.

As another example, it is conventional with analog audio cables to have different colours (such as by having coloured banding or other coloured marking or the like on the cable or connectors) to show whether the cable is for a stereo left or a stereo right, or for centre, front left, front right, rear left, rear right and subwoofer of a 5.1 sound system, etc. The same colour is used at the end of each cable and there is no distinction between one end of the cable being the input end and the other end of the cable being the output end. In such a case, if for example a user connects a cable to an audio out of a source device (such as a set-top box), then the receiver device (such as a television set) should show the corresponding audio input socket for the user to make for correct connection, and not the audio output socket. In such a case, the signal type information is transmitted.

To illustrate this further, assume for example that a user first connects the cable 50 to a right audio in RCA socket of a surround sound processor or home theatre system. The surround sound processor or home theatre system should send information such as "analog audio in, right channel via RCA socket" to show the type of signal and the type of socket to which the first end of the cable has been connected (or, equivalently, "analog audio out, right channel via RCA socket" to show the type of signal and the type of socket to which the other end of the cable should be connected) for receipt by the other device, such as a television set. When the television set receives the wireless signal, the television set indicates the right audio out RCA socket for the user to enable a correct connection to be made to the television set. It may be noted that this enables the user to make the correct connection even if the user is using the "wrong" or incorrect coloured cables (such as using red for the left channel and white for the right channel, when conventionally red is used for the right channel and white is used for the left channel).

As another example, as is known, DVI signals can be sent via DVI sockets or HDMI sockets. In such a case and depending on the availability of sockets on the respective devices 10, 20, it may not be sufficient for the source device 10, 20 merely to indicate that the type of signal is "DVI". For example, the user may be using an HDMI socket on the source device to output DVI signals. In such a case, the information that is sent by the source device to the receiver device should indicate information such as "DVI signal from HDMI socket". The receiver device can then indicate an HDMI socket to which the user should connect the other end of the cable.

As mentioned, when a cable 50 is connected to a socket 16, 18, 26, 28 of a device 10, 20, the wireless transceiver 14, 24 of that device 10, 20 wirelessly transmits a signal for receipt by the wireless transceiver 14, 24 of the other device 10, 20. The device 10, 20 may detect that a cable 50 has been connected to a socket 16, 18, 26, 28 by any suitable arrangement. For example, the sockets 16, 18, 26, 28 may contain a cable detector in the form of a mechanical switch or an optical detector or the like which detects when a cable 50 has been connected to the socket 16, 18, 26, 28. For each socket 16, 18, 26, 28, the device 10, 20 stores information that indicates one or both of the type of socket and the type of signal that is respectively received at or transmitted from that socket 16, 18, 26, 28.

The output of the cable detector is then used in this example by the processor, etc., 12, 22 of the device 10, 20 to cause the wireless transceiver 14, 24 of the device 10, 20 to transmit a corresponding and appropriate signal for receipt by the other device 10, 20. As noted, that signal indicates at least one of the type of signal that will be output at or can be input to that socket 16, 18, 26, 28 and the type of that socket 16, 18, 26, 28 of the first device 10, 20.

The other device 10, 20, upon receiving the wireless signal, can then indicate for the user the correct corresponding socket 16, 18, 26, 28 on the other device 10, 20 to which the other end of the cable 50 should be connected. A number of examples for this indication are possible.

For example, as indicated schematically in the drawings, one or both of the devices 10, 20 may be provided with an indicator 30 for one or more or each of the sockets 16, 26. In the example of FIG. 1, each device 10, 20 has an indicator 30 for each socket 16, 18, 26, 28. The indicators 30 are light sources for emitting light, each of which may be for example a small light bulb, LED, etc. Each indicator 30 is located close to its corresponding socket 16, 18, 26, 28. The indicator 30 can be caused to illuminate in order to indicate the socket 30 when necessary.

As another example, one or both of the devices 10, 20 may have a display screen on which a graphical representation of the sockets 16, 18, 26, 28 may be presented when a particular one of the sockets 16, 18, 26, 28 is to be indicated for connection of a cable 50. The particular one of the sockets 16, 18, 26, 28 to which the other end of the cable 50 should be connected may be indicated by highlighting the socket using a different colour from other sockets, and/or by a flashing icon effect, etc. Some devices 10, 20, including for example television sets as well as other devices, already have a display screen, which can be used for this purpose.

Prior to or as part of the process of connecting one or more cables 50 to the devices 10, 20, the devices 10, 20 may be registered with each other so that the devices 10, 20 can send appropriate wireless signals to each other. For example, the devices 10, 20 may be configured to be in a "discovery" mode so that when they are brought sufficiently close to each other, they can locate each other and can be paired. For this, the devices 10, 20 may transmit wireless discovery signals when put in discovery mode, and can respond to wireless discovery signals received from other devices that are transmitting wireless discovery signals. Such functionality is available with for example Bluetooth devices and others.

Alternatively or additionally, the wireless signals that are transmitted by a device 10, 20 to which a cable 50 has been connected may be effectively broadcast so as to be receivable by any other compatible device that receives the signals. When any compatible device receives a signal, the device may then operate as discussed above to indicate a socket to which the other end of the cable 50 should be connected.

As noted, once a device 10, 20, which is the first device to which a cable 50 has been connected, sends a wireless signal indicating at least one of the type of socket to which the cable 50 has been connected and the type of signal that will be present at that socket, the second device 10, 20, upon receiving the wireless signal, can indicate a socket on the second device 10, 20 to which the other end of the cable 50 should be connected. In an example, once a cable 50 has been connected to the indicated socket on the second device 10, 20, the second device 10, 20 detects this and sends a wireless signal to the first device 10, 20 to indicate that a correct connection has been made. The first device 10, 20 can then cease transmitting the signal that indicates at least one of the type of socket to which the cable 50 has been connected and the type of signal that will be present at the socket of the first device 10, 20. Alternatively or additionally, the first device 10, 20 may be arranged to transmit the signal for a certain period of time only, or may be arranged to transmit the signal only a certain number of times.

In the case that the second device 10, 20 does not have a suitable socket to which the other end of the cable 50 should be connected, the second device 10, 20 can indicate this for the user. For example, the second device 10, 20 may have an appropriate type of socket corresponding to the type indicated by the first device 10, 20, but all sockets of that type on the second device 10, 20 may already be occupied. As another example, the second device 10, 20 may not have a socket of the type indicated by the first device 10, 20. The second device 10, 20 can indicate this for the user by for example presenting a warning message on its own display screen if it has a display screen or by for example flashing a red warning light or the like. As another example, the second device 10, 20 can indicate this for the user by wirelessly transmitting a corresponding wireless signal for receipt by the first device 10, 20. The first device 10, 20 can then indicate for the user that there is no appropriate (free) socket on the second device 10, 20. Again, in the case that the first device 10, 20 has a display screen, the first device 10, 20 can present some warning on the display screen for the user. As another example, the first device 10, 20 may indicate this by for example flashing a red warning light or the like. This may be a warning light that is associated with the socket on the first device 10, 20 to which the first end of the cable 50 was connected.

It will be understood that the processor or processing system or circuitry referred to herein may in practice be provided by a single chip or integrated circuit or plural chips or integrated circuits, optionally provided as a chipset, an application-specific integrated circuit (ASIC), field-programmable gate array (FPGA), digital signal processor (DSP), graphics processing units (GPUs), etc. The chip or chips may comprise circuitry (as well as possibly firmware) for embodying at least one or more of a data processor or processors, a digital signal processor or processors, baseband circuitry and radio frequency circuitry, which are configurable so as to operate in accordance with the exemplary embodiments. In this regard, the exemplary embodiments may be implemented at least in part by computer software stored in (non-transitory) memory and executable by the processor, or by hardware, or by a combination of tangibly stored software and hardware (and tangibly stored firmware).

Reference is made herein to data storage for storing data. This may be provided by a single device or by plural devices. Suitable devices include for example a hard disk and non-volatile semiconductor memory (including for example a solid-state drive or SSD).

Although at least some aspects of the embodiments described herein with reference to the drawings comprise computer processes performed in processing systems or processors, the invention also extends to computer programs, particularly computer programs on or in a carrier, adapted for putting the invention into practice. The program may be in the form of non-transitory source code, object code, a code intermediate source and object code such as in partially compiled form, or in any other non-transitory form suitable for use in the implementation of processes according to the invention. The carrier may be any entity or device capable of carrying the program. For example, the carrier may comprise a storage medium, such as a solid-state drive (SSD) or other semiconductor-based RAM; a ROM, for example a CD ROM or a semiconductor ROM; a magnetic recording medium, for example a floppy disk or hard disk; optical memory devices in general; etc.

The examples described herein are to be understood as illustrative examples of embodiments of the invention. Further embodiments and examples are envisaged. Any feature described in relation to any one example or embodiment may be used alone or in combination with other features. In addition, any feature described in relation to any one example or embodiment may also be used in combination with one or more features of any other of the examples or embodiments, or any combination of any other of the examples or embodiments. Furthermore, equivalents and modifications not described herein may also be employed within the scope of the invention, which is defined in the claims.

The invention claimed is:

1. A method of operating first and second electronic devices, in which in use one of the devices acts as a source of at least one of video and audio which is sent to the other device over a cable, the method comprising:

detecting at a socket of the first device that a cable connector of a cable has been connected to the socket of the first device;

in response to detecting that a cable connector has been connected to the socket of the first device, the first device transmitting a wireless signal for receipt by the second device, the wireless signal indicating at least one of (i) the type of signal that is output or input at that socket of the first device and (ii) the type of socket for that socket of the first device; and in response to the second device receiving the wireless signal, the second device indicating a corresponding socket on the second device to which a cable connector at the other end of the cable should be connected.

2. A method according to claim 1, wherein, in response to detecting that the cable connector at the other end of the cable has been connected to the indicated socket of the second device, the second device transmits a wireless signal for receipt by the first device, the wireless signal indicating that a correct connection has been made.

3. A method according to claim 2, wherein, in response to receiving from the second device the wireless signal that indicates that a correct connection has been made, the first device ceases transmitting the wireless signal for receipt by the second device.

4. A method according to claim 1, wherein the second device indicates a corresponding socket on the second device to which the cable connector at the other end of the cable should be connected by illuminating a light emitter in the region of said corresponding socket on the second device.

5. A method according to claim 1, wherein the second device comprises a display screen, and wherein the second device indicates a corresponding socket on the second device to which the cable connector at the other end of the cable should be connected by displaying a representation of the location of said corresponding socket on the display screen of the second device.

6. A method according to claim 1, wherein the wireless signal indicates the type of signal that is output or input at that socket of the first device.

7. A method according to claim 1, wherein the wireless signal indicates the type of socket for that socket of the first device.

8. A method according to claim 1, wherein the wireless signal indicates the type of signal that is output or input at that socket of the first device and the type of socket for that socket of the first device.

9. An electronic device for acting as at least one of a source and a receiver of at least one of video and audio which in use is sent to or received from respectively another device over a cable, the electronic device comprising:

at least one socket for receiving a cable connector of a cable which in use carries at least one of a video signal and an audio signal which is output or input at the socket;

a cable detector for detecting that a cable connector has been connected to the socket; and a wireless transmitter for transmitting wireless signals;

the device being arranged to cause the wireless transmitter to transmit a wireless signal for receipt by another device when a cable connector of a cable has been connected to the socket, in which the wireless signal indicates at least one of (i) the type of signal that is output or input at that socket and (ii) the type of socket for that socket, whereby, upon receipt of said wireless signal, a said other device can indicate a corresponding socket on said other device to which the cable connector at the other end of the cable should be connected.

10. An electronic device according to claim 9, the device comprising a wireless receiver for receiving wireless signals, the device being arranged such that, in response to receiving from a said other device a wireless signal that indicates that a correct connection has been made at said other device, the device ceases transmitting the wireless signal for receipt by another device.

11. An electronic device according to claim 9, the device comprising a wireless receiver for receiving wireless signals, the device being arranged to indicate the socket or one of the sockets on the device to which a cable connector of a cable should be connected in response to receiving a wireless signal from another device which indicates at least one of (i) the type of signal that is output or input at a socket of said other device to which a cable connector at the other end of a said cable is connected and (ii) the type of socket for a socket of said other device to which a cable connector at the other end of a said cable is connected.

12. An electronic device according to claim 11, the device being arranged to indicate the socket or a socket on the device to which the cable connector of a said cable should be connected by illuminating a light emitter in the region of said socket on the device.

13. An electronic device according to claim 11, the device comprising a display screen, the device being arranged to indicate the socket or a socket on the device to which the cable connector of a said cable should be connected by displaying a representation of the location of said socket on the display screen.

14. An electronic device according to claim 9, the device being arranged such that the wireless signal indicates the type of signal that is output or input at that socket.

15. An electronic device according to claim 9, the device being arranged such that the wireless signal indicates the type of socket for that socket.

16. An electronic device according to claim 9, the device being arranged such that the wireless signal indicates the type of signal that is output or input at that socket and the type of socket for that socket.

17. An electronic device for acting as at least one of a source and a receiver of at least one of video and audio which in use is sent to or received from respectively another device over a cable, the electronic device comprising:

a wireless receiver for receiving wireless signals; and at least one socket for receiving a cable connector of a cable which in use carries at least one of a video signal and an audio signal which is output or input at the socket;

the device being arranged to indicate the socket or one of the sockets on the device to which a cable connector of a cable should be connected in response to receiving a wireless signal from another device which indicates at least one of (i) the type of signal that is output or input at a socket of said other device to which a cable connector at the other end of a said cable is connected and (ii) the type of socket for a socket of said other device to which a cable connector at the other end of a said cable is connected.

18. An electronic device according to claim 17, the device being arranged to transmit a wireless signal for receipt by said other device in response to detecting that the cable connector of a said cable has been connected to the indicated socket of the device, the wireless signal indicating that a correct connection has been made.

19. An electronic device according to claim 17, the device being arranged to indicate the socket or a socket on the device to which the cable connector of a said cable should be connected by illuminating a light emitter in the region of said socket on the device.

20. An electronic device according to claim 17, the device comprising a display screen, the device being arranged to indicate the socket or a socket on the device to which the cable connector of a said cable should be connected by displaying a representation of the location of said socket on the display screen.

* * * * *